United States Patent [19]

Bako

[11] 4,155,234

[45] May 22, 1979

[54] SURFACE MOUNT COMBINATION LOCK

[75] Inventor: Lazlo Bako, Woodcliff Lake, N.J.

[73] Assignee: Presto Lock Company, Division of Walter Kidde & Company, Inc., Garfield, N.J.

[21] Appl. No.: 841,465

[22] Filed: Oct. 12, 1977

[51] Int. Cl.[2] ..... E05B 37/12

[52] U.S. Cl. ..... 70/312; 70/316; 70/70

[58] Field of Search ..... 70/68–76, 70/287–288, 304–306, 312, 315–318, 327–328

[56] References Cited

U.S. PATENT DOCUMENTS 2,007,663 7/1935 Rapp ..... 70/306

*Primary Examiner*—Robert L. Wolfe

*Attorney, Agent, or Firm*—Shapiro and Shapiro

[57] ABSTRACT

A combination lock for luggage, for example, which may be surface mounted. Dial gears and cooperable gears have separate axes parallel to the thickness of the lock. In the on-combination position, hubs of the cooperable gears are aligned with openings in a slide that is moved relative to the hubs to permit an actuator to move a latch to its open position. The latch may also be moved to its open position by a hasp, even when the combination is scrambled. A shifter, which has an operator accessible at the face of the lock only when the hasp has been released by the latch, moves the slide and the cooperable gears as a unit, to disengage the cooperable gears from the dial gears for changing the combination.

31 Claims, 18 Drawing Figures

FIG. 11
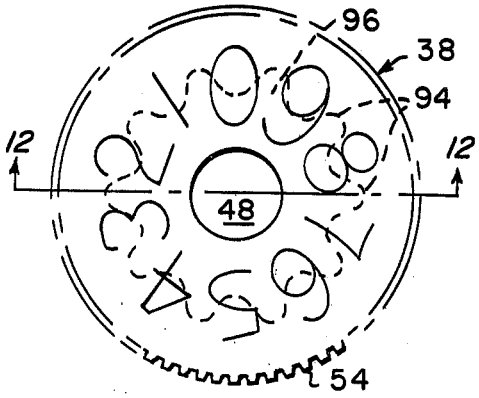
FIG. 12
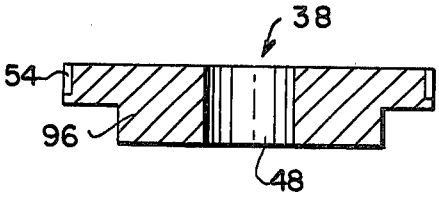
FIG. 13
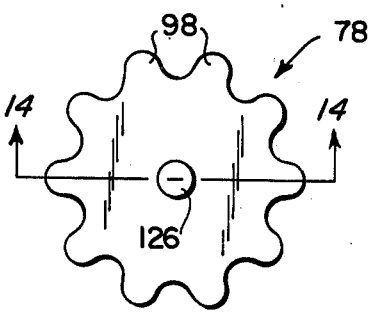
FIG. 14
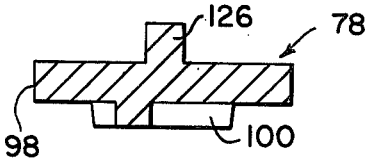
FIG. 15
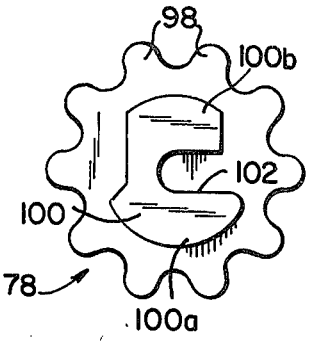
FIG. 16
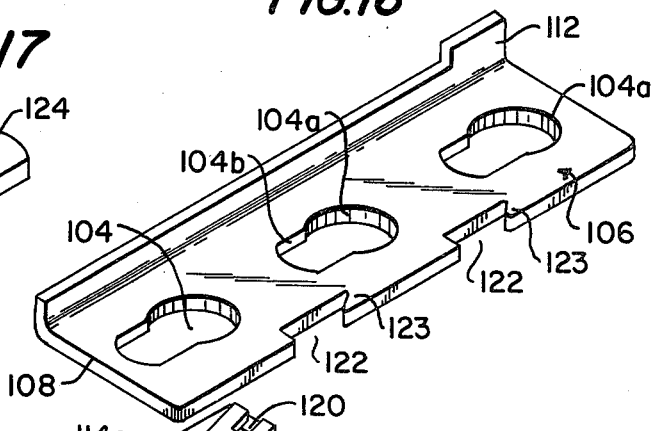
FIG. 17
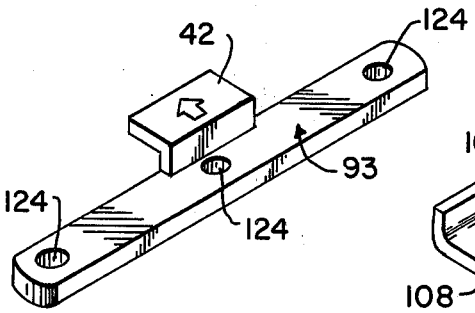
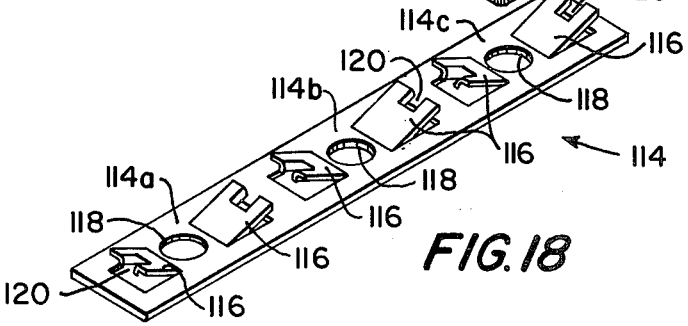
FIG. 18

SURFACE MOUNT COMBINATION LOCK

BACKGROUND OF THE INVENTION

This invention relates to combination or permutation locks and is more particularly concerned with combination locks that may be surface mounted on luggage and the like.

Thin or flat surface-mounted combination locks are well-known. Such locks eliminate the need for large openings in panels of luggage, for example, that usually are required to provide clearance for the frame of the lock. Prior combination locks capable of being surface mounted suffer from one or more deficiencies, including complexity, high cost of manufacture, poor reliability, inability to lock the device when the combination is scrambled, inability to change the combination easily and properly, sensitivity to shock forces, and poor dial spring construction.

BRIEF DESCRIPTION OF THE INVENTION

It is accordingly a principal object of the invention to provide an improved combination or permutation lock, particularly a thin surface-mounted lock which permits the user to change the combination easily, at the face of the lock, but only when the lock is open.

A further object of the invention is to provide an improved combination lock in which a shifter, that is moved to permit changing the combination, is accessible at the face of the lock only when the lock is open, in which the shifter need not be held manually during the changing of the combination, and in which the lock cannot operate normally until the shifter is returned to its normal position.

Yet another object of the invention is to provide an improved combination lock which may be locked even when off-combination.

A still further object of the invention is to provide a combination lock with improved dial springs and improved cooperation between the dials and dial springs.

An additional object of the invention is to provide an improved combination lock which will strongly resist opening by shock forces.

Briefly stated, in one of its broader aspects, the invention comprises a combination lock with a case having a plurality of combination dials, the dials being supported for rotation in the case about separate axes that are parallel, each dial having a dial gear that rotates with the dial about its axis and each gear meshing with a cooperable gear, the cooperable gears being supported for rotation in the case about separate axes that are parallel to the axes of the dials. Control means is supported for movement in a predetermined direction in the case relative to the cooperable gears, and the cooperable gears have means for blocking movement of the control means in the predetermined direction except when the dials are on-combination. An actuator means moves the control means in the predetermined direction and also moves latch means to an open position. The latch means is preferably a lever that is spring-biased to a closed position and is movable to its open position independently of the actuator means.

In another aspect of the invention, shifter means, having an operator that is exposed at the face of the lock when the lock is open, moves the cooperable gears away from the dial gears in unison to permit the combination to be changed.

In yet another aspect of the invention, dial spring means for each dial comprises a pair of arms extending divergently from the axis of the dial and toward the periphery of the dial gear, the arms being compressed by the dial gear and having notches at the ends of the arms receiving dial gear teeth.

BRIEF DESCRIPTION OF THE DRAWINGS

The foregoing and other objects and features of the invention will become more readily apparent upon consideration of the following detailed description of the invention in conjunction with the accompanying drawings, which illustrate a preferred and exemplary embodiment, and wherein:

FIG. 11 is a top plan view of one of the dials employed in the lock, showing in dash lines a dial gear on the underside of the dial;

FIG. 12 is a sectional view taken along line 12—12 of FIG. 11;

FIG. 13 is a top plan view of one of the cooperable gears employed in the lock;

FIG. 14 is a sectional view taken along line 14—14 of FIG. 13;

FIG. 15 is a bottom plan view of the cooperable gear of FIG. 13;

FIG. 16 is a perspective view of a slide which cooperates with the cooperable gears for determining when the lock can be opened;

FIG. 17 is a perspective view of a shifter which moves the cooperable gears and the slide in unison to permit changing of the combination; and FIG. 18 is a perspective view of a dial spring member employed in the lock.

DESCRIPTION OF THE PREFERRED EMBODIMENT

Figure 1:
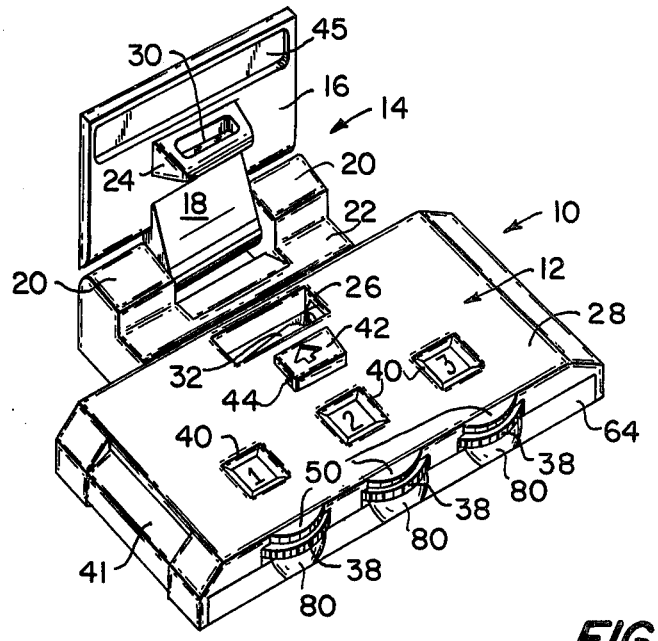
FIG. 1 is a perspective view showing a combination lock of the invention in its open condition.

Referring to the drawings, and initially to FIG. 1, a combination lock 10 of the invention preferably comprises a case 12 that may be surface mounted on a wall or panel of luggage, for example. As will be seen hereinafter, by virtue of a novel lock mechanism the lock may have a case of minimal thickness while permitting the user to change the combination easily, at the face of the lock. The lock may have a hasp 14 adapted to be surface mounted upon another wall or panel that is to be held in closed abutment position with respect to the panel upon which the case 12 is mounted. In the form shown, hasp 14 comprises a flat plate or tongue 16 having an integral sleeve 18 pivotally supported between spaced posts 20 integral with a base 22. Hook 24 of the tongue is adapted to enter an opening 26 in a plate 28 forming part of the case 12 and has a recess 30 which receives one end of a spring-biased pivoted latch or bolt 32. Sleeve 18 turns on a shaft 34 (FIG. 10) that extends between posts 20. A coil spring 36 turns the tongue 16 to extract hook 24 from opening 26 when the lock is opened. In practice, the spring may turn the tongue beyond the position shown in FIG. 1, until the tongue is directed away from case 12.

Peripheral portions of three dials 38 protrude from an edge of case 12. The dials bear numbers or other characters that are exposed individually, preferably through windows 40 in plate 28 at the face of case 12. To open the lock an actuator 41, preferably recessed into an edge of case 12, is pushed into the case. As will be seen hereafter, actuator 41, which may be termed a "puller", can only be depressed sufficiently to open the lock when the dials are on-combination. When the lock is open, a tab 42, which serves as an operator of a "shifter" to be described later, is exposed at the face of the lock. Tab 42 projects through a slot 44 in plate 28 and is covered by tongue 16 when the lock is closed, being received in a recess 45 of the tongue. The tab is manually moved in the direction of the arrow shown thereon to permit changing the combination of the lock, as will be described later.

Figure 2:
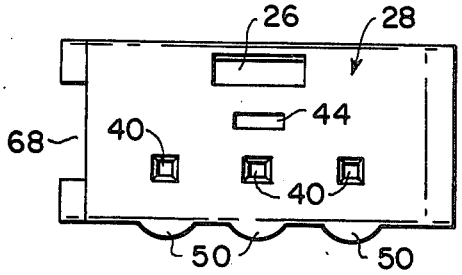
FIG. 2 is a top plan view of a plate forming part of the case of the lock.
Figure 3:
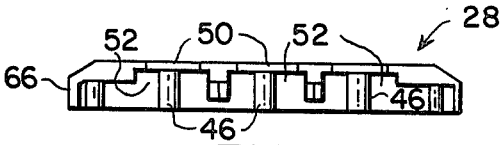
FIG. 3 is a side elevation view of the plate.
Figure 4:
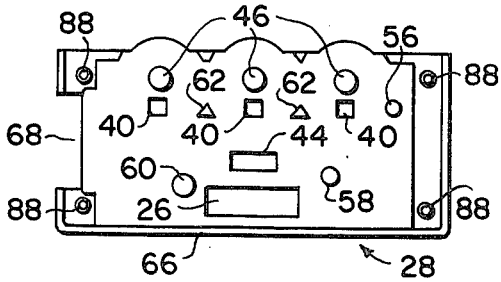
FIG. 4 is a bottom plan view of the plate.

The preferred configuration of plate 28 is clearly shown in FIGS. 2–4. Shanks 46, depending integrally from the underside of the plate, rotatably support the dials 38, each of which has a central opening 48, as shown in FIG. 11, for receiving a shank. The plate may be formed with "eyelids" 50 over slots 52 through which the dials protrude, the eyelids covering the dials except for the knurled peripheries 54. Studs 56 and 58 support springs (to be described) and stud 60 serves as a pivot for the bolt 32. Studs 62 of triangular cross-section cooperate with a reciprocating plug as will be described later. All of these studs depend from the underside of plate 28 and are integral therewith.

Figure 5:
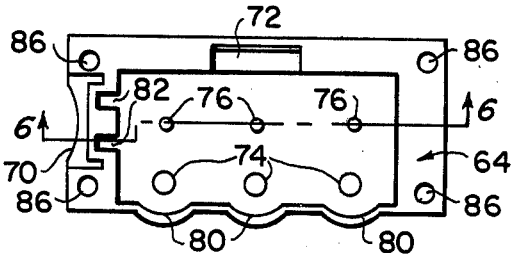
FIG. 5 is a top plan view of a frame forming part of the case of the lock.
Figure 6:
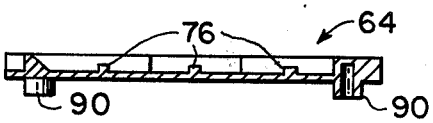
FIG. 6 is a sectional view taken along line 6—6 of FIG. 5.
Figure 7:
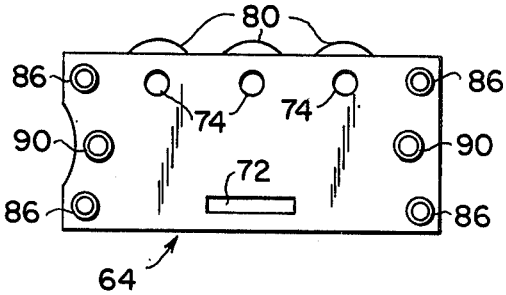
FIG. 7 is a bottom plan view of the frame.

To form the case 12 of the lock, plate 28 is assembled with a frame 64, shown in detail in FIGS. 5–7. Both the plate and the frame are generally rectangular in the preferred form of the invention, and these parts of the lock as well as parts 16 and 22 may be die-cast, for example. When the plate is assembled with the frame, a lip 66 of the plate partially covers side and end edges of the frame. See FIGS. 1, 9 and 10. As shown in FIGS. 2, 4 and 5, a slot 68 at one end of plate 28 and a recess 70 at the corresponding end of frame 64 accommodate the actuator 41.

Figure 9:
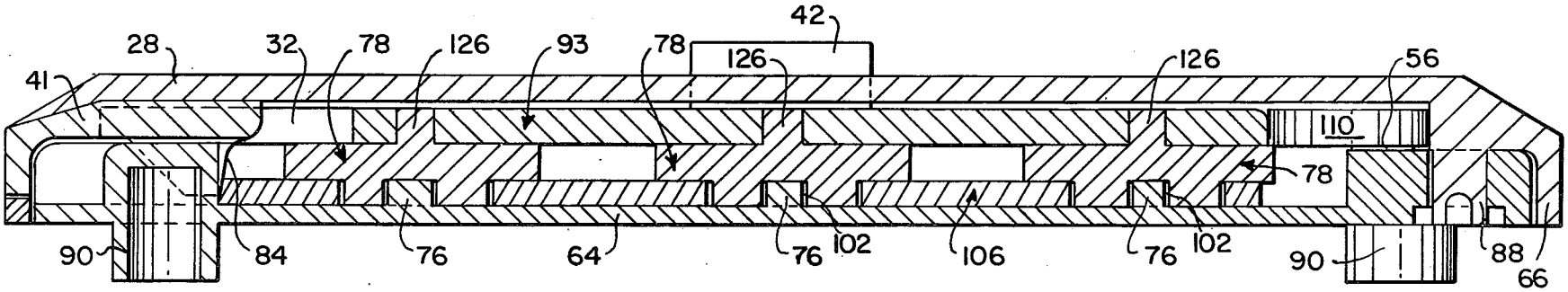
FIG. 9 is a sectional view taken along line 9—9 of FIG. 8.
Figure 10:
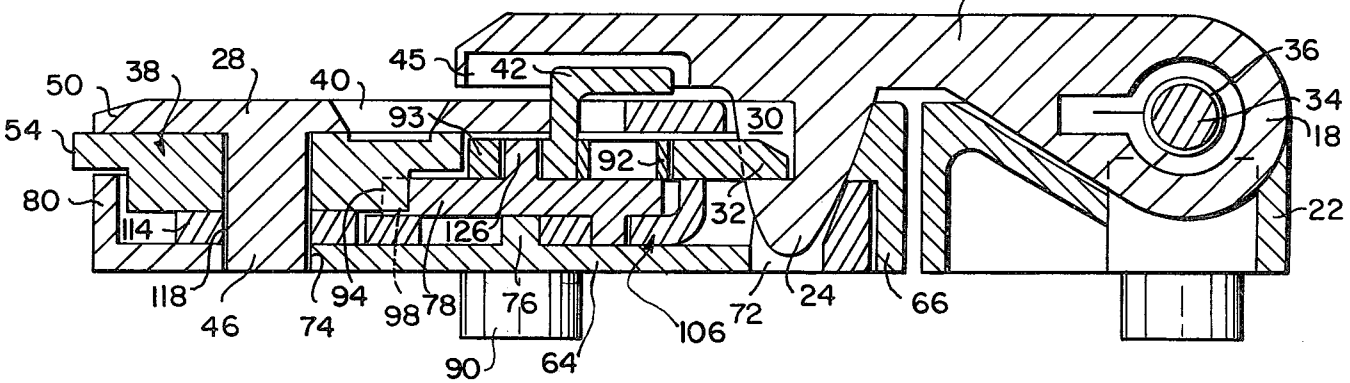
FIG. 10 is a sectional view taken along line 10—10 of FIG. 8.

Frame 64 has a slot 72 to accommodate the hook 24, as shown in FIG. 10. The frame also has three holes 74 which receive the shanks 46 of the plate and has three internal bosses 76 upon which sleeves 78 are rotatably supported. See FIG. 9. "Eyelids" 80 complement eyelids 50 of the plate. Internal grooves 82 of the frame (FIG. 5) receive corresponding legs 84 of the actuator 41 for guiding reciprocative movement of the actuator and for limiting the movement of the actuator outwardly of the case 12. See FIGS. 8 and 9. Four holes 86 at the corners of the frame receive corresponding closing rivets 88 of the plate 28 (FIG. 4) for joining the plate to the frame. Closing rivets 90, which project from the bottom of the frame (FIGS. 6 and 7) are inserted in holes in a panel or wall (not shown) for surface mounting the case 12.

Figure 8:
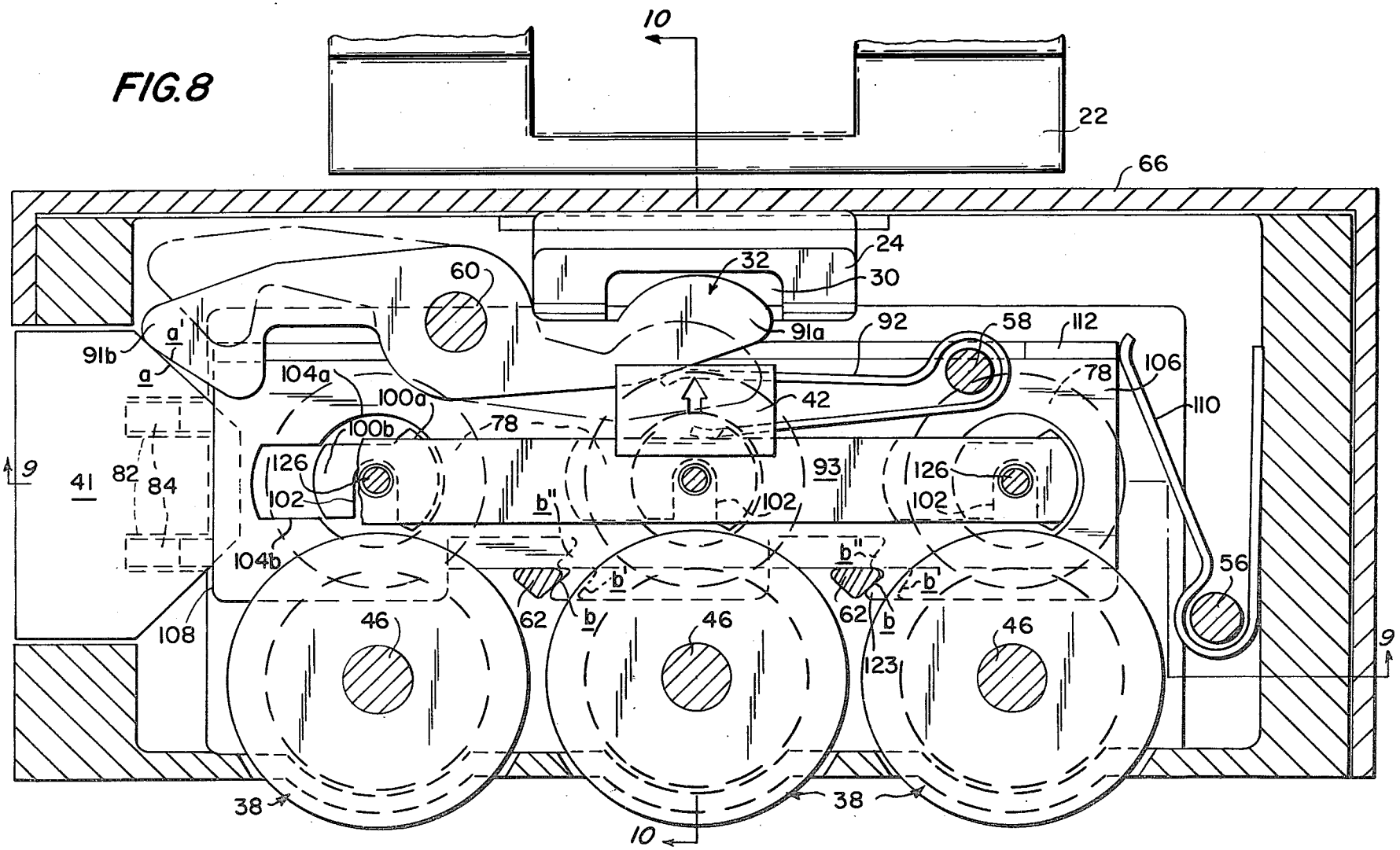
FIG. 8 is a horizontal sectional view illustrating the lock mechanism, with parts of the case, the shifter, and the hasp removed or broken away for clarity of illustration of the mechanism.

Turning now to the details of the lock mechanism in the preferred embodiment, as shown in FIG. 8 latch 32 is preferably an almost symmetrical lever with a hole at its center by which the latch is pivotally mounted on stud 60 of plate 28. One end 91*a* of the latch, which is preferably rounded, is biased into recess 30 in the hook 24 by a hairpin spring 92 supported on stud 58. One leg of the spring engages end 91*a* of the latch, and the other leg of the spring engages a shifter 93, to be described later. The other end 91*b* of the latch is preferably wedge-shaped for camming engagement with the generally trapezoidal actuator 41.

When the actuator is manually moved to the right in FIG. 8, engagement of edge a of the actuator with the opposed edge a′ of the latch moves the latch to the phantom line position, releasing the hook 24, so that spring 36 opens the lock. Latch 32 is preferably mass-balanced about its pivot 60, so that the lock will not pop open when subjected to shock forces. Since end 91*b* of the latch moves away from actuator 41 to release the hook 24, the hook may be re-engaged with the latch independently of the position of actuator 41. When the hook 24 is inserted into slot 26 of the plate (FIG. 1), the hook, being tapered as shown, cams latch 32 out of the way, and then the latch snaps into the recess 30, reclosing the lock. The re-closing is independent of the combination mechanism of the lock, and thus the lock may be closed even when the combination is scrambled.

Referring now to FIGS. 11–15, it will be noted that the underside of each dial 38 is formed with integral gear teeth 94 which provide a dial gear 96 of diameter smaller than the diameter of the dial. Each sleeve 78 is itself a gear cooperable with a dial gear and having teeth 98 which normally mesh with teeth 94 of a dial gear 96. See FIGS. 8 and 10. Thus, when the dials are turned, the associated cooperable gears are turned also.

The underside of each cooperable gear 78 is formed with an integral hub 100 having a notch 102 in which an associated boss 76 of the frame 64 is received, as shown in FIGS. 9 and 10. The hubs 100 cooperate with a control means, preferably a slide or plug 106 (FIG. 16) to determine when the lock can be opened. In the preferred form, slide 106 is supported on frame 64 for longitudinal and lateral movement and has holes 104 for receiving corresponding hubs 100. The shapes of the hubs 100 and the holes 104 are correlated so that the slide 106 can move in a predetermined direction relative to the hubs when, and only when, the hubs have a predetermined orientation. For this purpose each hub 100 may have an arcuate part 100*a* and a rectangular part 100*b*. The entire hub is small enough to fit into a circular part 104*a* of the corresponding hole 104 in slide 106, and when the hubs are so positioned (FIG. 8), gears 78 may turn freely on bosses 76.

When the rectangular parts 100*b* of the hubs are all oriented in the same direction and aligned with corresponding rectangular parts 104*b* of holes 104, as shown in FIG. 8, slide 106 may be moved to the right in FIG. 8 to thread rectangular parts 104*b* of holes 104 onto the rectangular parts 100*b* of hubs 100, thereby preventing gears 78 from turning. Only in the on-combination position of the dials 38 (where gears 78 have a predetermined orientation) are the hubs 100 so aligned, and only in that position can the slide 106 move to the right in FIG. 8. If any dial is in an off-combination position, its hub 100 will engage an edge of the corresponding opening 104 and block such movement of slide 106.

Although the actuator 41 is not attached to slide 106, the depending legs 84 of the actuator engage end 108 of the slide when the actuator is moved to the right in FIG. 8. Thus, the actuator can only be moved to the right sufficiently to rotate the latch 32 to its open position when slide 106 is free to move to the right also —i.e., only when the lock is on-combination. One leg of a hair-pin spring 110 engages lug 112 of slide 106 and normally biases the slide to the left in FIG. 8, so that the left end of the slide is forced against legs 84 of the actuator. The other leg of the spring engages a wall of the frame 64.

It is apparent that opening the lock requires longitudinal movement of slide 106 in a predetermined direction, which is only possible when hubs 100 of gears 78 have a critical rotational position in the holes 104 of the slide. Gears 78 are, of course, rotated by the dials 38. The rotational position of dials 38 is resiliently maintained by a dial spring member 114 (FIG. 18) which is preferably a rectangular leaf spring plate with three sets 114*a*, 114*b*, 114*c* of oppositely directed resilient arms 116. The arms of each set extend divergently from the axis of an associated dial and toward the periphery of the dial gear. The arms of each set are preferably struck from the plate at opposite sides of a hole 118 through which a dial-pivot stud 46 passes as shown in FIG. 10. Each arm has a notch 120 with edges rolled toward spring plate 114. Dials 38, which overlie spring plate 114 (FIG. 10) partially compress the associated spring arms 116, and oppositely directed gear teeth 94 of each dial gear enter notches 120 of corresponding oppositely directed arms. When a dial is turned, the teeth captured by notches 120 ride over the rolled edges of the notches, compressing the spring arms 116 further until the next gear teeth enter the notches and the next dial number is exposed at the associated opening 40 in case 12. There is no rubbing between the dial springs and the number-carrying surfaces of the dials, and thus the numbered surfaces are not subjected to wear.

To open the lock, dials 38 are set on-combination, so that slide 106 can be moved longitudinally when actuator 41 is pushed. To change the combination, slide 106 is moved longitudinally, as in opening the lock, and is then moved laterally away from the dials 38. As shown in FIG. 16, slide 106 has notches 122 in one edge. Studs 62, which depend from plate 28 as stated previously, are received within these notches. (See FIG. 8) In the normal position of slide 106 (the full-line position in FIG. 8), triangular noses 123 at one end of the notches engage one side of posts 62, as indicated at b, preventing lateral movement of the slide away from the dials 38. When actuator 41 is pushed in, moving slide 106 to the right in FIG. 8, the noses 123 move to the right and away from posts 62 to the positions illustrated by phantom lines b′, freeing slide 106 for lateral movement away from the dials.

Tab 42 is employed to move the slide 106 and gears 78 in unison away from dials 38. As shown in FIG. 17, the tab is an integral part of shifter 93, which is a bar having three holes 124 in which central bosses 126 of gears 78 rotate. See FIGS 8–10 and 14. It will be recalled that movement of slide 106 to the right in FIG. 8 threads rectangular parts 104*b* of holes 104 onto the corresponding rectangular parts 100*b* of hubs 100 of gears 78, trapping the hubs in the slide with a fixed orientation of the gears. In this orientation, notches 102 of the hubs are aligned with their open end toward the dials 38, as shown in FIG. 8. Gears 78, which normally rotate centered on fixed-pivot bosses 76 of frame 64 (FIGS. 9 and 10) can then be moved off-center of bosses 76 and away from the dials. Thus, when slide 106 has been moved to the right in FIG. 8 and the lock is opened, tab 42 may be pressed in the direction of the arrow thereon to move the shifter 93, gears 78 and slide 106 as an assembly (against the bias of spring 92), disengaging the gear teeth 98 of gears 78 from the gear teeth 94 of the dials. If tab 42 is held pressed and actuator 41 is released, spring 110 will move slide 106 and actuator 41 to the left in FIG. 8, moving the noses 123 behind studs 62 as indicated at b″. If tab 42 is now released, spring 92 pressing on shifter 93 will engage noses 123 with studs 62. The lateral position of the shifter 93, slide 106 and gears 78 will then be maintained without tab 42 being held manually, and gears 78 will remain disengaged from the dial gears. The dials can then be turned independently of gears 78 to set a new combination. If actuator 41 is then pressed again, moving slide 106 to the right in FIG. 8, the noses 123 will be released from studs 62. Spring 92 will then move the shifter 93, slide 106 and gears 78 in a direction opposite to the arrow on tab 42, re-engaging the gears 78 with the dial gears. When actuator 41 is released, spring 110 will move slide 106 to the left in FIG. 8, back to the normal position. The lock can only be operated normally after the shifter mechanism has been returned to its normal position. Then, after the lock is closed, it can only be opened by setting dials 38 to the new combination.

It is apparent that the invention provides a unique combination lock that can be readily and economically manufactured. Since each gear 78 rotates about an axis separate from the associated dial 38, rather than rotating about the same axis in a stacked arrangement, the case of the lock can readily be made quite thin, for unobtrusive surface mounting. The arrangement of dials and cooperable gears employed in the invention avoids crowding of the dials and provides easily operated dials and easily read dial numbers. Dial action is smooth and positive, without wear of the numbered surfaces. The lock can be closed even when the combination is scrambled, and the combination is easily changed at the face of the lock, but only when the lock is open. Moreover, after the combination is changed, the lock will not operate in the normal manner until the shifter is returned to its normal position, preventing accidental loss of the combination.

While a preferred embodiment of the invention has been shown and described, it will be apparent to those skilled in the art that changes can be made in this embodiment without departing from the principles and spirit of the invention, the scope of which is defined in the appended claims.

I claim:

1. A combination lock comprising a case having a plurality of combination dials, the dials being supported for rotation in the case about separate parallel axes, each of the dials having a dial gear that rotates with the dial about its axis, and each of the dial gears meshing with a cooperable gear, the cooperable gears being supported for rotation in the case about separate axes that are parallel to the axes of the dials, latch means supported on the case for movement between closed and open positions, control means supported for movement in a predetermined direction in the case relative to the cooperable gears, the cooperable gears having means for blocking such movement of the control means in said predetermined direction except when the dials are on-combination, and actuator means for moving the control means in said predetermined direction, the actuator means being capable of moving the latch means to its open position but only when the control means is free to move in said predetermined direction.

2. A combination lock in accordance with claim 1, wherein the latch means is movable from its closed position to its open position independently of the actuator means.

3. A combination lock in accordance with claim 1, wherein the latch means is a lever that is separate from the actuator means but may be moved thereby.

4. A combination lock in accordance with claim 3, wherein the lever is mass-balanced about a central pivot.

5. A combination lock in accordance with claim 1, wherein the control means comprises a slide.

6. A combination lock in accordance with claim 5, wherein the slide is separate from the actuator means but is spring biased into engagement therewith so that it may be moved thereby.

7. A combination lock in accordance with claim 1, wherein the case is of minimal thickness and the dials rotate about axes parallel to the thickness of the cass.

8. A combination lock in accordance with claim 7, wherein the dials have peripheral portions protruding from an edge of the case and have characters at one side of the dials exposed individually through windows in a face of the case.

9. A combination lock in accordance with claim 1, further comprising shifter means for moving the cooperable gears away from the dial gears in unison to permit the combination to be changed.

10. A combination lock in accordance with claim 9, wherein the case has an opening through a face of the case at which a portion of the latch means is exposed for latching a hasp in the opening, the shifter means having an operator that is exposed at the face of the case only when the hasp is released by the latch means.

11. A combination lock in accordance with claim 10, wherein the control means comprises a slide having a plurality of holes therein and the cooperable gears have hubs rotatable in the holes, respectively, the holes having a shape correlated with the shape of the hubs to permit the slide to move in said predetermined direction relative to the hubs only when the cooperable gears have a predetermined orientation and then to fix the orientation of the cooperable gears, and wherein the shifter means comprises means for moving the slide and the cooperable gears as an assembly in a direction away from the dials.

12. A combination lock in accordance with claim 11, further comprising means for preventing the movement of the assembly away from the dials until the slide has been moved in said predetermined direction.

13. A combination lock in accordance with claim 12, further comprising means for holding the assembly away from the dials independently of the operator.

14. A combination lock comprising a plurality of combination dials, slide means, blocking means permitting the slide means to move in a predetermined diretion only when the dials are set on-combination, actuator means for moving the slide means in said predetermined direction, spring means for moving the slide means in the opposite direction, latch means moved by the actuator means from a closed position to an open position when the actuator means moves the slide means in said predetermined direction, and spring means for returning the latch means to its closed position when the slide means moves in said opposite direction, the latch means comprising a lever separate from the actuator means and movable to its open position independently of the actuator means.

15. A combination lock in accordance with claim 14, wherein the lever is pivoted between its ends and is mass-balanced about its pivot.

16. A combination lock in accordance with claim 14, and wherein the lever has one end spring-biased against the actuator means and movable away from the actuator means when the lever moves to its open position independently of the actuator means.

17. A combination lock comprising a plurality of combination dials each having a dial gear which rotates with the dial about its axis, a plurality of cooperable gears normally meshed with the dial gears, respectively, slide means having a plurality of holes therein, the cooperable gears having hubs rotatable in the holes, respectively, the shape of the hubs being correlated with the shape of the holes so that the slide means may move in a predetermined direction relative to the hubs only when the hubs have a predetermined orientation, actuator means for moving the slide means in said predetermined direction, means operable when the actuator means moves the slide means in said predetermined direction for opening the lock, and shifter means for moving the slide means and the cooperable gears with the shifter means away from the dial gears as an assembly, thereby to disengage the cooperable gears from the dial gears to permit the combination to be changed.

18. A combination lock in accordance with claim 17, wherein the shifter means has an operator that is exposed for manual operation only when the lock is open.

19. A combination lock in accordance with claim 17, wherein the slide means is moved longitudinally by the actuator means and is moved laterally by the shifter means.

20. A combination lock in accordance with claim 19, wherein the cooperable gears are rotatable upon fixed pivots, respectively, and the hubs have notches receiving the pivots, respectively, the notches being oriented to permit the hubs to move off-center of the pivots when the hubs have said predetermined orientation.

21. A combination lock in accordance with claim 19, further comprising means for preventing said lateral movement of the slide means until the slide means has been moved longitudinally in said predetermined direction, and means for maintaining the lateral position of the slide means after it has been moved laterally.

22. A combination lock in accordance with claim 21, wherein the preventing means comprises fixed studs received in corresponding notches at an edge of the slide means and wherein the maintaining means comprises portions of the slide means adjacent to the notches which move behind the studs when the slide means is moved laterally and then in a direction opposite to said predetermined direction.

23. A combination lock in accordance with claim 22, further comprising spring means for biasing the slide means in said opposite direction and spring means for biasing the shifter means toward the dial gears.

24. A combination lock in accordance with claim 22, wherein the actuator means is separate from the slide means so that the slide means may move laterally with respect thereto.

25. A combination lock in accordance with claim 17, wherein the shifter means has a plurality of holes therein and the hubs have corresponding pivots received in the last-mentioned holes.

26. A combination lock in accordance with claim 17, wherein the shape of the holes and the hubs is correlated so that the hubs are trapped in the holes with said predetermined orientation when the slide means moves in said predetermined direction.

27. A combination lock comprising a plurality of combination dials each having a dial gear at one side thereof rotatable with the dial about an axis, and dial spring means for each dial comprising a pair of arms extending divergently from the axis of the dial and toward the periphery of the dial gear, the arms being compressed by the dial gear and having notches at the ends of the arms receiving teeth of the gear.

28. A combination lock in accordance with claim 27, wherein each notch has rolled edges engaging a gear tooth received in the notch.

29. A combination lock in accordance with claim 27, wherein the arms are struck from a common spring plate.

30. A combination lock in accordance with claim 29, wherein the plate has a hole between the arms of each pair, each dial having a pivot extending through a corresponding hole.

31. A combination lock in accordance with claim 27, wherein each dial has characters at the side of the dial opposite to the dial gear and wherein the diameter of the dial gear is less than the diameter of the dial.

* * * * *